US005325615A

United States Patent [19]

Hutchins et al.

[11] Patent Number: 5,325,615

[45] Date of Patent: Jul. 5, 1994

[54] ATTACHMENTS FOR EXCAVATING BUCKETS

[75] Inventors: Brian J. Hutchins, Tualatin; William C. Johnston, Sherwood; Timothy L. Mayfield, Cornelius, all of Oreg.

[73] Assignee: ESCO Corporation, Portland, Oreg.

[21] Appl. No.: 38,076

[22] Filed: Mar. 29, 1993

Related U.S. Application Data

[63] Continuation of Ser. No. 811,288, Dec. 20, 1991, abandoned.

[51] Int. Cl.[5] ..... E02F 9/28

[52] U.S. Cl. ..... 37/455; 37/454; 37/452; 172/713

[58] Field of Search ..... 37/141 A, 141 T, 142 R, 37/142 A, 452, 455, 454, 446; 172/713, 762

[56] References Cited

U.S. PATENT DOCUMENTS

| | | | |
|---|---|---|---|
| 2,921,391 | 7/1955 | Opsahl | 37/142 |
| 3,774,324 | 11/1973 | Lafond | 37/142 R |
| 3,841,007 | 10/1974 | Howarth et al. | 37/141 R |
| 3,961,788 | 6/1976 | Helton et al. | 37/141 R |
| 4,103,442 | 8/1978 | Zepf | 37/142 R |
| 4,136,469 | 1/1979 | Zepf | 37/142 R |
| 4,187,035 | 2/1980 | Colburn | 403/318 |
| 4,231,173 | 11/1980 | Davis | 37/142 R |
| 4,267,653 | 5/1981 | Hahn et al. | 37/142 A |
| 4,271,615 | 6/1981 | Jones | 37/142 A |
| 4,319,415 | 3/1982 | Mayerbock et al. | 37/67 |
| 4,335,532 | 6/1982 | Hahn et al. | 37/142 R |
| 4,577,423 | 3/1986 | Hahn | 37/142 R |
| 4,602,445 | 7/1986 | Nilsson | 37/142 A |
| 4,727,663 | 3/1988 | Hahn | 37/142 A |
| 4,761,900 | 8/1988 | Emrich | 37/142 R |

FOREIGN PATENT DOCUMENTS

| | | | |
|---|---|---|---|
| 2938119 | 4/1981 | Fed. Rep. of Germany | 37/141 R |
| 3538156 | 7/1986 | Fed. Rep. of Germany | 37/142 R |
| 2095643 | 3/1982 | United Kingdom . | |

OTHER PUBLICATIONS

Vertalok: ESCO's New Generation Tooth System; Product Information, 1988 ESCO Corporation, E7-0-465-8.

Installing ESCO Weld-on Helilok Adapters; Maintenance Catalog 100-1F.

ESCO Standard Duty Bucket; 1988 ESCO Corporation E70-461-8.

Catalog 187, Section 13; ESCO Extra Heavy Duty Front End Loader Buckets; Effective Jul. 1980.

*Primary Examiner*—Randolph A. Reese

*Assistant Examiner*—J. Russell McBee

*Attorney, Agent, or Firm*—Banner, Birch, McKie & Beckett

[57] ABSTRACT

An attachment, adapted to mount to the front edge of an excavating bucket, includes a working structure and a base. The front edge of the bucket defines an inner surface, an outer surface, and a beveled surface oriented at an inclination to the inner and outer surfaces. The base of the attachment includes a single leg or pair of legs having opposed engagement surfaces. The engagement surfaces on the two legged attachments diverge from one another to define a gap therebetween for receiving the lip of the bucket. One of the engagement surfaces defines a convex surface which enables the attachment to be mounted to a variety of different buckets irrespective of the inclination of the beveled surface of the front edge.

35 Claims, 6 Drawing Sheets

ATTACHMENTS FOR EXCAVATING BUCKETS

This is a continuation of co-pending application Serial No. 07/811,288, filed on Dec. 20, 1991 and now abandoned.

FIELD OF THE INVENTION

The present invention pertains to a unique construction for attachments (e.g., adapters, shrouds and wings) adapted to mount to the front edge of an excavating bucket.

BACKGROUND OF THE INVENTION

Excavating buckets are used extensively in the construction and mining industries. Buckets are used with a variety of different excavating apparatus, such as back hoes, power shovels, front end loaders, dragline equipment, etc. Although these buckets have many differences, they are generally formed with a rear wall, side walls and a bottom wall. The walls cooperatively define an open front and a cavity for gathering earthen material and moving it to a dump site. The bottom edge of the open front is defined by a forward lip of the bottom wall. The lip is intended to engage the ground for collection of the material into the bucket's cavity. The lip may be formed to have a linear or arcuate shaped edge, or formed to have a particular configuration (such as V-shaped) to suit the desired operation. Similarly, the front edges of the side walls are also adapted to engage the ground.

Attachments are commonly mounted on the lip and the front edges of the side walls to increase the effectiveness and durability of the buckets. These attachments typically include teeth, shrouds and wings. The teeth project forwardly of the lip to disrupt the material for enhanced collection of the material into the cavity. The shrouds are positioned in between the teeth and are generally provided with an inclined surface to improve the collection of the material into the bucket. The wings are attached to the front edges of the side walls in general proximity with the lips. In any event, the attachments protect the bucket against undue wearing. As a result, only the attachments normally need replacement when the front of the bucket becomes worn; thus, prolonging the usable life of the larger and more expensive lip and side walls.

In most cases, a tooth is formed of an adapter and a point. The adapter is attached to the lip and serves as a mount for the point. The point is a wear element and forms the forward portion of the tooth that engages the ground. The point may be attached to the adapter in a number of different ways. Examples of such arrangements are disclosed in U.S. Pat. Nos. 4,231,173 to Davis, 4,335,532 to Hahn et al., and 4,727,663 to Hahn. As a result of this two-part construction, replacement of only the point is generally needed when the tooth becomes worn.

The attachments are each formed with a forward working portion and a rearward mounting portion. The forward working portions of the adapters include structures to facilitate attachment of the points. The forward working portions of the shrouds and wings typically include surfaces designed to engage the worked material and guide it into the bucket. The rearward portions of the attachments are typically bifurcated to define a pair of legs. The bifurcated legs straddle the lip so that one leg lies against the interior of the bucket and one leg lies against the exterior thereof. In some bifurcated designs one leg extends only a very short distance rearward of the lip edge. Alternatively, some designs have only one leg that lies against the interior of the bucket. In any event, the legs generally have hollow central portions to provide greater weight reduction. As a result of this hollowed construction, a peripheral rim is defined around the legs for engaging the lip.

The attachments can be secured to the bucket in a number of different ways. For instance, the attachments may be secured through the use of a wedge locking system, such as disclosed in U.S. Pat. Nos. 4,267,653 to Hahn et al. and 4,271,615 to Jones. Alternatively, the attachments may be secured to a lip by welding or bolting.

The lips and side walls of different buckets are not generally uniform in shape and are often manufactured with leading beveled edges which are oriented at different inclinations. The leading beveled edge is an inclined surface at the forward end of the lip or side wall, which lies in a plane intersecting the exterior and interior surfaces. The inclination is upwardly and rearwardly with respect to the outer surface. Hence, irrespective of the type of mounting arrangement used to secure the attachment to the bucket, a unique attachment is ordinarily required for each different bucket to accommodate the different configuration. This special manufacturing of the attachments not only increases fabrication costs, but also creates a substantial inventory for users and distributors.

SUMMARY OF THE INVENTION

In accordance with the present invention, attachments having a unique mounting construction are provided to alleviate the aforementioned problems.

The attachments (e.g., adapters, shrouds and wings) of the present invention include mounting portions having bifurcated legs which straddle the lip or side wall of the bucket or a single leg which lies against the interior of the bucket. The interior leg includes a ramp portion for engaging the leading beveled edge. The rim of the ramp portion is formed with a convex configuration. The term "convex" herein refers to any outwardly bowed shape having an angular or arcuate configuration, and which is bowed in either one or more directions. The convex shape permits the legs to firmly engage the lip or side wall, irrespective of the angular orientation of the leading beveled edge. Specifically, the ramp portion of the attachment engages the leading beveled edge near the crotch or front part of the leg or legs when secured to a front edge with a relatively long and gradually inclined beveled edge surface. However, when the attachment is secured to a front edge with a shorter and steeper beveled edge surface, the ramp portion engages the surface nearer the opposite end of the ramp. Thus, many leading beveled edge angular orientations are accommodated with only a few convex ramp style attachments. As can be readily appreciated, such an improvement permits greater mass production and thus lowers manufacturing cost. Moreover, inventory is greatly reduced.

DETAILED DESCRIPTION OF THE PREFERRED EMBODIMENTS

Figure 1:
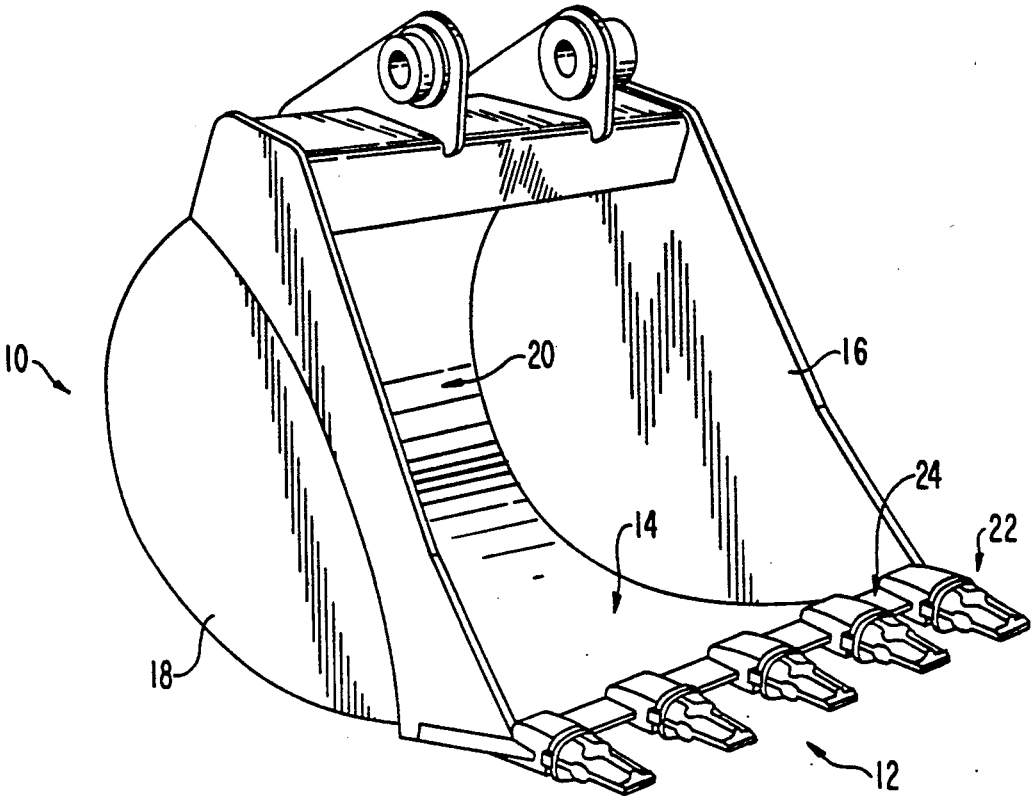
FIG. 1 is a perspective view of one type of bucket with attachments secured to the lip.
Figure 2:
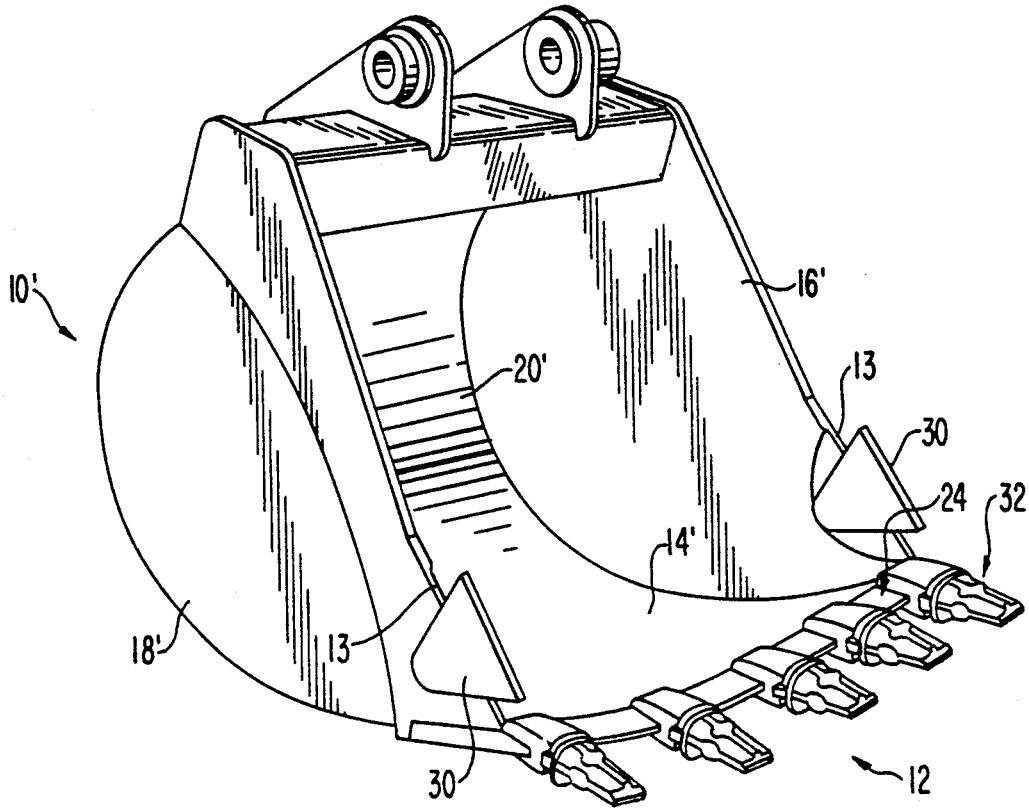
FIG. 2 is a perspective view of another type of bucket with attachments secured to the front edges.

The present invention pertains to attachments adapted to be secured to the lip 12 or other front edge 13 of a bucket 10 (FIGS. 1 and 2). The structure of the bucket as a whole is not critical to the present invention. A bucket designed for attachment to a back hoe is shown for illustration purposes only. The present invention pertains to attachments for many different kinds of buckets (not shown), including buckets for front end loaders, power shovels, dragline operations, etc. These buckets in one form or another generally include a bottom wall 14, a pair of side walls 16, 18, and a rear wall 20. In the bucket 10 of FIG. 1, bottom wall 14 and rear wall 20 form a continuous arcuate surface and the side walls are generally vertical planar members. Nevertheless, many different shapes and sizes of buckets are usable with the attachments of the present invention.

The attachments of the present invention are adapted to be mounted on the front lip 12 or front edge 13 of bucket 10. While these generally include teeth 22, shrouds 24 and wings 25, the present invention could encompass other attachments designed for connection to the bucket. In a typical arrangement, teeth 22 are secured to the lip in a spaced apart relationship (FIGS. 1 and 2). Shrouds 24 are secured in the gaps defined between the teeth. The teeth project forwardly of the lip and function to disrupt the ground. The shrouds generally have sloped forward surfaces to guide the disrupted ground into the bucket cavity. The wings 25 (FIG. 2) are attached to the front edges 13 of side walls 16, 18 in general proximity to the lip. In any event, the attachments function to protect the bucket against undue wearing. Although, the below discussion focuses on the construction of various adapters and shrouds, the same principles are equally applicable to other attachments, such as wings.

Figure 3:
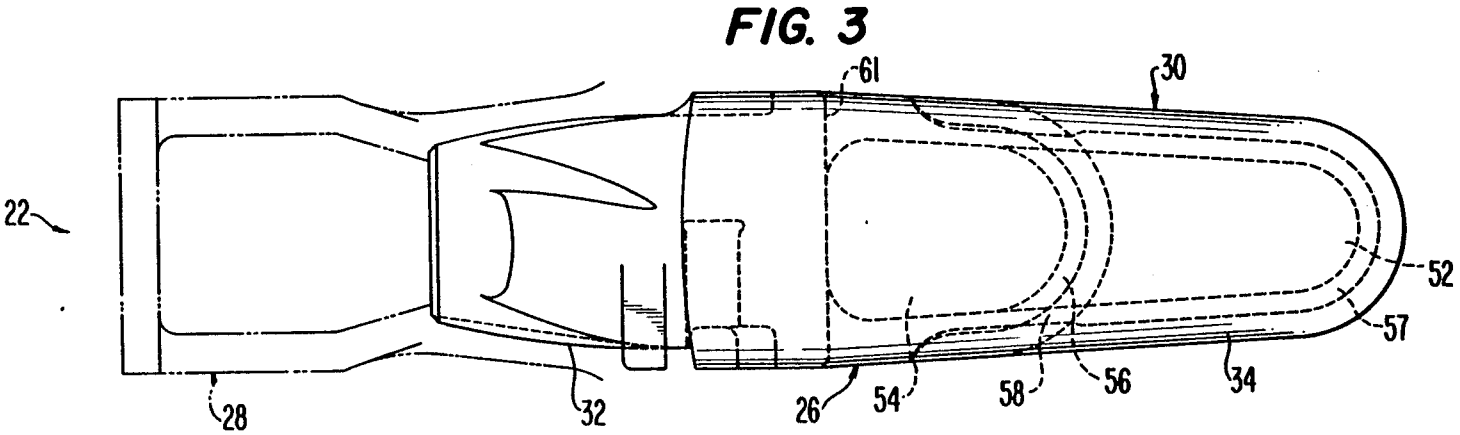
FIG. 3 is top plan view of one embodiment of an adapter with an accompanying point shown in phantom.
Figure 4:
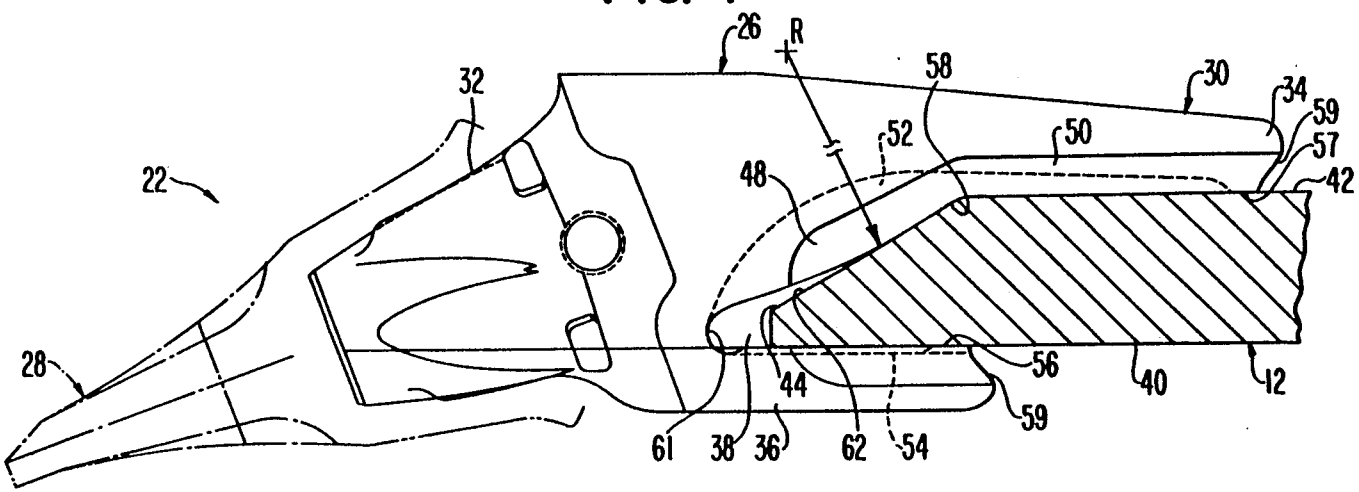
FIG. 4 is side elevational view of the adapter mounted on a lip, with the point shown in phantom.
Figure 15:
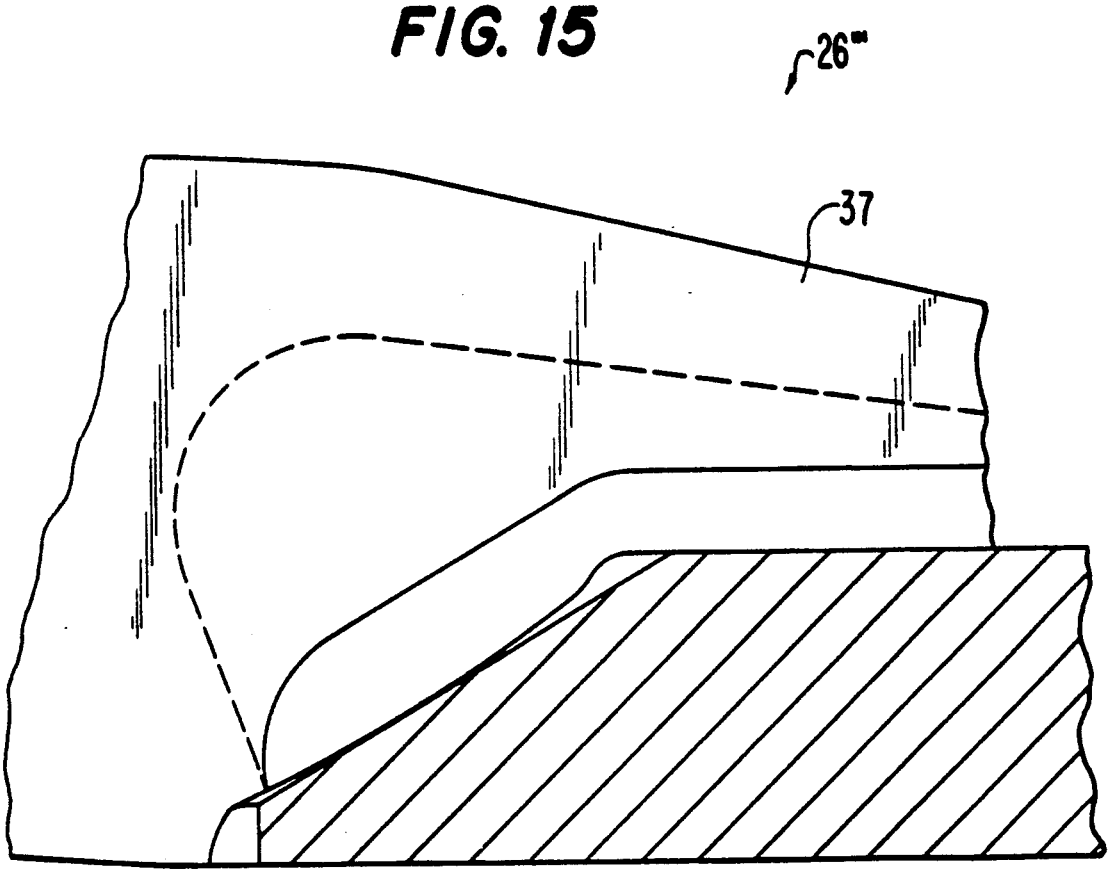
FIG. 15 is a partial side view of another embodiment of an adapter mounted to a lip of a bucket.

Adapters 26 are typically cast as a single element composed of a hardened metal material in order to provide sufficient strength in the harsh environment in which it operates (FIGS. 3–5, and 15). Adapter 26 includes a rear portion 30 and a forward portion 32. Rear portion 30 is designed to mount the adapter to lip 12 of the bucket. Forward portion 32 is designed to securely hold point 28 in place. With respect to the present invention, forward portion 32 can have any construction which is effective for mounting a point. FIGS. 3–5 and 10 illustrate such a structure known in the art. Rear portion 30 of adapter 26 may include a pair of bifurcated legs 34, 36 (FIGS. 4–5 and 8–9) or a single interior leg 37 (FIG. 15). In general, single leg 37 is shaped the same as top leg 34 of the bifurcated leg assembly. The bifurcated legs 34, 36 define a generally V-shaped gap 38 therebetween (FIG. 4). Gap 38 is designed to receive the forward lip 12 of a bucket 10 such that legs 34, 36 straddle the lip.

The lip of a bucket, as seen in FIG. 4, defines a lower or outside surface 40, an inner or upper surface 42, and a leading beveled edge surface 44. The beveled edge surface 44 is inlined upwardly and rearwardly with respect to outer surface 40. The inclination of beveled surface edge 44 varies from bucket to bucket. For instance, some lips have a short, steep beveled edge **44*a*, while others have a longer, more gradually sloped beveled edge 44*b*, as seen in FIGS. 8 and 9**.

Figure 8:
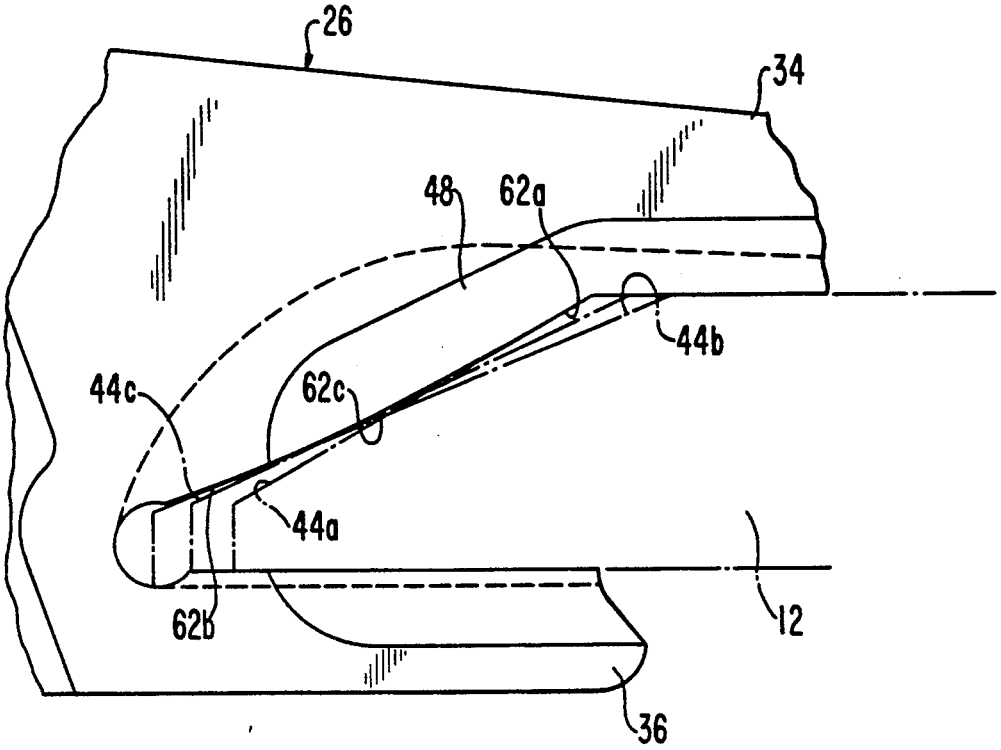
FIG. 8 is an enlarged partial side view of a portion of the legs of an adapter with differently shaped lips shown in phantom.
Figure 9:
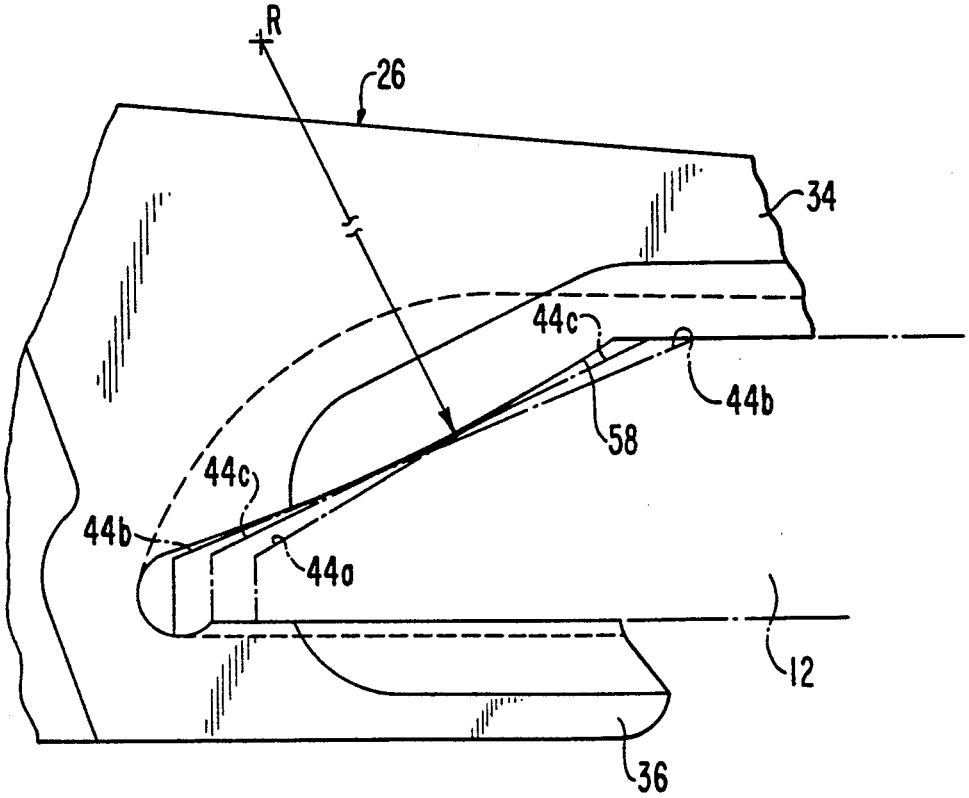
FIG. 9 is an enlarged partial side view of a portion of the legs of another embodiment of the adapter with differently shaped lips shown in phantom.

In general, bottom leg 36 of adapter 26 engages outer surface 40, and top leg 34 engages beveled surface 44 and inner surface 42 (FIGS. 4 and 8–9). Top leg 34 thus includes two portions—namely, a ramp portion 48 which engages beveled surface 44 and rear distal portion 50 which engages inner surface 42. Legs 34 and 36 define hollow interiors 52, 54 for weight-saving purposes and outer rims 56, 57, 58 surrounding the hollow interiors. The adapters shown in FIGS. 3–5 and 10 are weld-on adapters, and therefore each includes an additional arcuate recess 59 along the perimeter of the legs to facilitate the welding of the adapter to lip 10. Although not illustrated, the present invention is also applicable to adapters secured to the lip in other ways.

Figure 5:
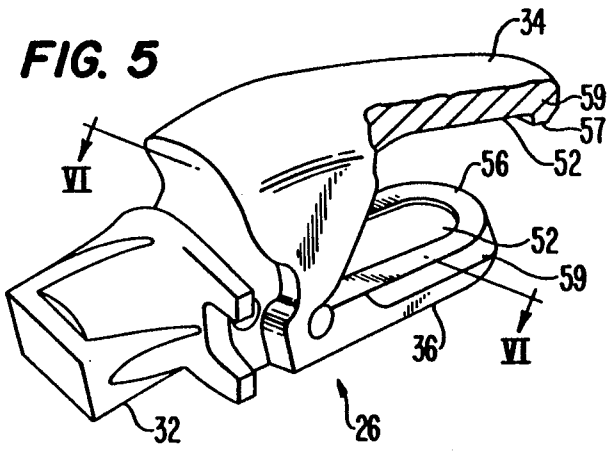
FIG. 5 is a perspective view of another embodiment of an adapter with a portion of the inside leg cut-away.
Figure 6:
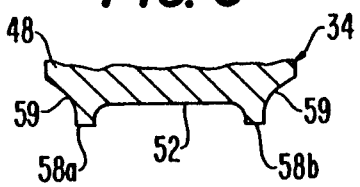
FIG. 6 is a cross-sectional view of the adapter taken along line VI—VI in FIG. 5.

As best seen in FIGS. 3–5, rim 56 of bottom leg 36 is essentially a U-shaped member which is contiguously engaged against outer surface 40 of lip 10. The length of the bottom leg 36 is not critical to the present invention, as is illustrated by the different embodiments shown in FIGS. 4 and 5. Similarly, rim 57 of rear portion 50 of top leg 34 is also a generally U-shaped member which lies flush against inner surface 42. Rim 58 of ramp portion 48 defines a pair of spaced-apart linear tracks **58*a*, 58*b*, (FIG. 6), which are aligned with the arm segments 57*a*, 57*b* of the U-shaped configuration of rim 57. In keeping with the shape of the top leg 34, rim 58 is inclined relative to rim 57**.

Moreover, in the present invention, rim 58 is formed to have a generally convex configuration. As mentioned above, the term "convex" is used to identify a generally outwardly bowed shape, irrespective of whether the bowed surface is angular or arcuate in shape or whether it is bowed in one or more directions. The convex shape of rim 58 enables the adapter to be secured to lips having beveled edges 44 of different inclinations. Of course, the convex shape could be used without the formation of a rim and hollowed interior. Further, the convex shape may be formed in a number of different ways.

First, each track **58*a*, 58*b* of rim 58 may be formed as a multiangled ramp having a series of planar surfaces 62** placed at orientations to correspond to beveled edges of specific lips (FIG. 8). For instance, the most inward planar surface 62*b* of rim 58 (i.e., the portion nearest crotch 61) may be placed at one particular angular orientation so that it flushly engages with a beveled edge surface 44*b* inclined at a shallow angle. The more outward planar surfaces 62*a*, 62*c* of rim 58 would be placed at different and successively greater inclinations than the previous inward surfaces, so that they would correspond and flushly engage against beveled edges 44*a*, 44*c* having steeper angles of inclination. Any reasonable number of surfaces may be provided. The transition point from one surface to another surface along rim 58, can be formed as an arcuate or angular corner.

Another construction forms rim 58 as a continuous curvilinear arcuate ramp (FIG. 9). In this construction, the rim surfaces are outwardly bowed about a radius of curvature R (FIG. 9). In a preferred embodiment the radius of curvature equals about 16.2 inches. Nevertheless, other radii or curvature may be used as well as a curvature defined by a plurality of different radii of curvature. In particular, each track 58*a, b* of curvilinear rim 58 will engage the beveled edge 44 along a transverse line. The particular location of the engagement along the rim will vary depending upon the inclination of the beveled edge surface engaged. For instance, if the beveled edge surface 44*b* has a relatively gradual inclination, rim 58 will engage the beveled edge 44*b* at a location proximate to the crotch 61 of the legs. However, if the beveled edge surface 44*a, c* has a steeper inclination, it will engage the rim 58 at a location further from the crotch 61. In general, the smaller the angle of inclination is for the beveled edge, the closer its engagement with rim 58 will be to crotch 61.

Figure 7:
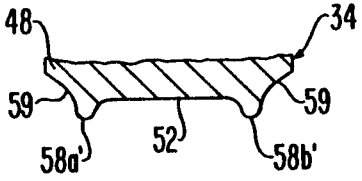
FIG. 7 is a cross-sectional view of another embodiment of the adapter taken along line VI—VI in FIG. 5.

Finally, either of the first two alternatives may be further formed so that the tracks 58*a*, 58*b* of rim 58 are each formed as a compound convex surface. More specifically, the rim may be formed to curve not only in the direction of the legs, but also in the direction transverse to the legs (FIG. 7). This construction will have the greatest capacity of universal mounting among any of the alternatives. However, the engagement of each track 58*a*, 58*b* with the beveled edge surface 44 will be reduced to a line when used with the first angular rim structure (FIG. 8) and to point contact when used with the arcuate rim structure (FIG. 9). Nevertheless, in view of the flush engagement of rims 56 and 57 with outer and inner surfaces 40, 42, respectively, and the welding around the entire perimeter of the legs (or other securing means), the contact provides sufficient strength for excavating, mining, and general material handling operations.

Figure 10:
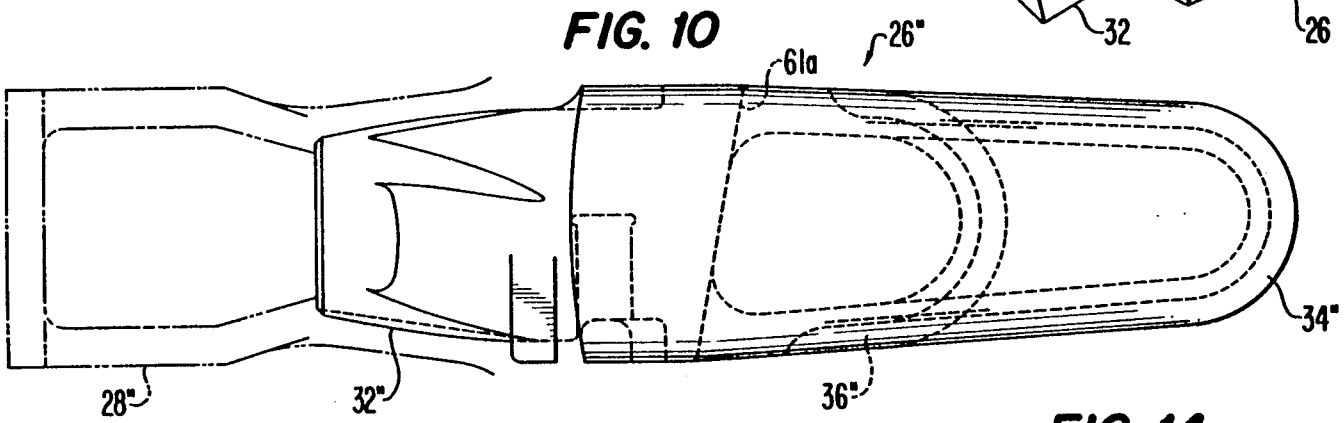
FIG. 10 is a top plan view of another embodiment of an adapter with the accompanying point shown in phantom.

These same convex structures may also be used in connection with adapters 26″ designed to attach to buckets having a curved front lip 12″ (FIGS. 2 and 10). In these buckets, the front lip 12″ is generally shaped to project outwardly (or inwardly) in an angular or curvilinear fashion. To accommodate this construction, the adapters are at times formed with an inclined edge 61*a* along crotch 61. With this construction, the point still projects straight ahead, and the legs still project rearwardly for sufficient engagement with the lip.

The single leg adapters 26‴ (FIG. 15) also include the same inventive features as the bifurcated leg adapters. Specifically, leg 37 includes an engagement surface which defines a convex surface in the same way as the top leg of the embodiments having the bifurcated legs. Although FIG. 15 illustrates and arcuate convex surface, it should be understood that the embodiment is not limited to this type of convex structure.

Figure 14:
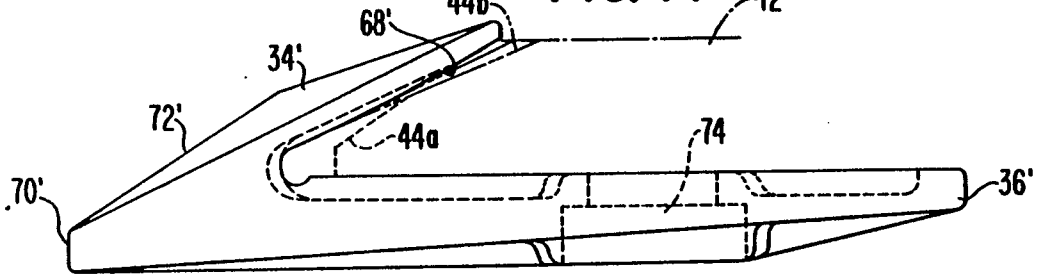
FIG. 14 is a side elevational view of a second embodiment of a shroud with differently shaped lips shown in phantom.
Figure 11:
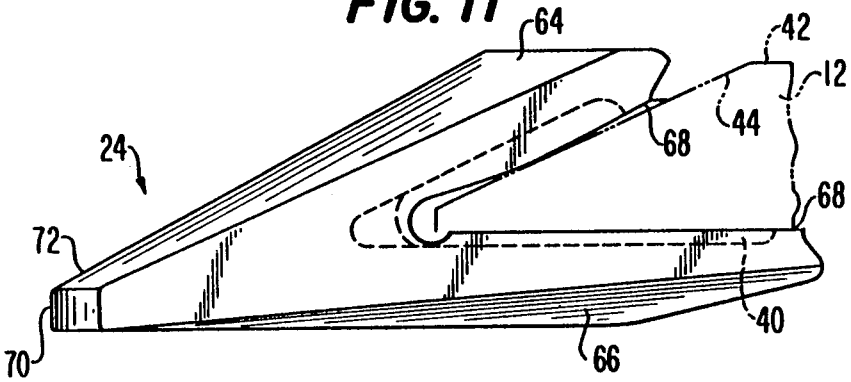
FIG. 11 is a side elevational view of a shroud, with a lip shown in phantom.
Figure 13:
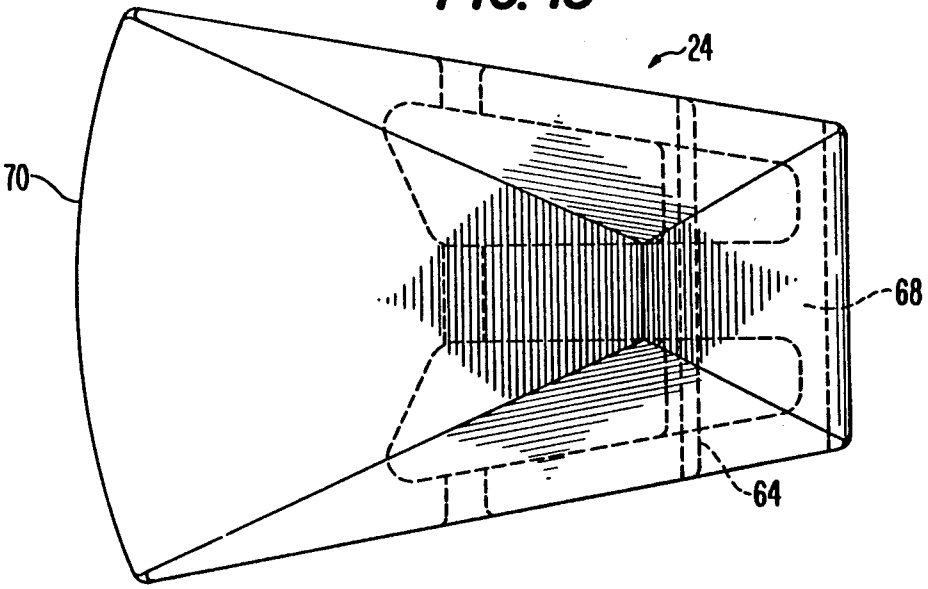
FIG. 13 is a bottom plan view of the shroud.
Figure 12:
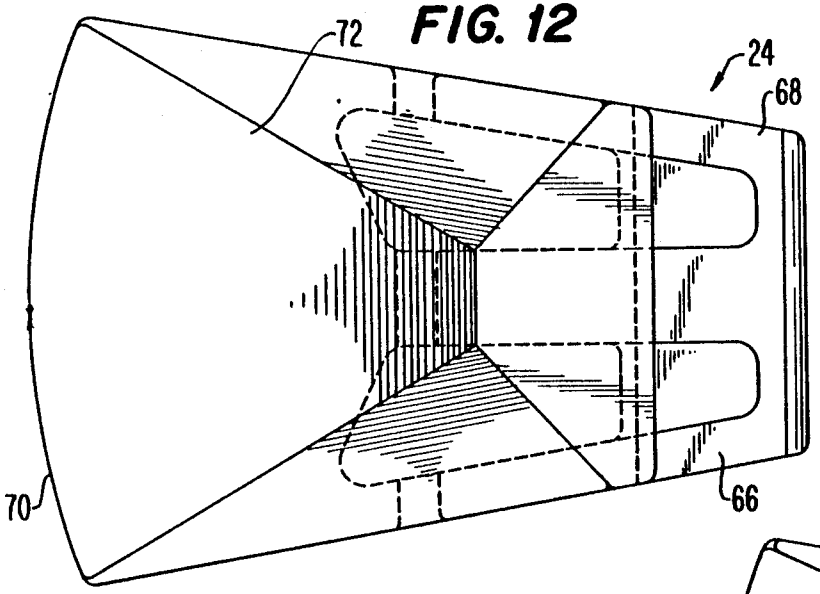
FIG. 12 is top plan view of the shroud.

Likewise, the same convex structures of the present invention are also applicable to shrouds 24 (FIGS. 11–14). For illustration purposes, FIGS. 11–13 show a weld-on type shroud, and FIG. 14 shows a bolt-on type shroud.

The shroud generally include a forward edge 70, an upper sloped surface 72 for guiding the disrupted material into the bucket cavity, and a pair of legs 64, 66. The bolt-on shroud further includes a countersunk bore 74 for receiving the bolt and nut fastener (not shown).

As with the two-legged adapters, legs 64, 66 diverge from one another to define a gap for receiving the lip. However, in contrast to adapters, the top leg of shroud 24 typically only includes a ramp portion, because the shrouds do not resist the same level of forces as the adapters. Nevertheless, an additional leg portion to extend over and against inner surface 42 could be provided. As with the adapter legs, the shroud legs 64, 66 are commonly formed with hollowed interiors and surrounding rims 68 for weight-saving purposes; although the present invention can be practiced without the hollow interior and rims 68. Rims 68 are illustrated as generally W-shaped structures which engages the beveled edge 44. Rims 68 through may be U-shaped (as are the adapters) or any other shape meeting the requisite characteristics of the invention. Rim 68 is provided with the same convex shapes as described for rim 58 of adapter 26. Specifically, rim 68 can be formed as a multi-angled surface, an arcuate surface, or a compound convex surface.

The present invention has a wide application to many buckets, and may be used for any attachments which mount to the front of a bucket. Further, it is understood that the above discussed structures are merely preferred embodiments of the invention, and that various other embodiments as well as many other changes and alterations may be made without departing from the spirit and broader aspects of the invention as defined in the claims.

We claim:

1. An attachment adapted to mount to a front edge of a bucket, the front edge defining an inner surface, an outer surface and a beveled surface oriented at an inclination to the inner and outer surfaces, said attachment comprising a unitary, single piece body having a rear base portion adapted to engage and mount the attachment to the front edge of a bucket and a working end projecting forwardly from said base portion, said base portion including an end face facing in a generally rearward direction and at least one rearwardly extending leg having a generally convex-shaped face engaging the beveled surface of the bucket upon assembly, said body further including a recess defined by at least said convex-shaped face and said end face, said recess being continuously open rearwardly and laterally to accommodate receipt of the front edge of the bucket.

2. An attachment in accordance with claim 1, in which said convex face is defined by a plurality of generally planar surfaces arranged at different angular orientations with respect to one another.

3. An attachment in accordance with claim 2, in which said convex face is further defined such that said planar surfaces are successively arranged with increasing inclinations as the leg extends rearwardly into the bucket.

4. An attachment in accordance with claim 1, in which said convex face has a convex configuration in longitudinal and lateral directions.

5. An attachment in accordance with claim 1, in which said convex face has an arcuate configuration.

6. An attachment in accordance with claim 5, in which said arcuate convex face has a substantially constant radius of curvature.

7. An attachment in accordance with claim 5, in which said arcuate convex face is defined by a plurality of successive arcuate portions, wherein adjacent arcuate portions are formed with different radii or curvature.

8. An attachment in accordance with claim 5, in which said arcuate convex face has a convex configuration in longitudinal and lateral directions.

9. An attachment in accordance with claim 1, in which said attachment is and adapter and said working structure is a structure for mounting a point.

10. An attachment in accordance with claim 1, in which said attachment is a shroud and said working structure is an outer surface adapted to engage the material to be collected in the bucket.

11. An attachment in accordance with claim 1, in which said attachment is a wing adapted for mounting to a said wall of the bucket and said working structure is adapted to engage the material to be collected in the bucket.

12. An attachment in accordance with claim 1, in which said leg includes a hollow interior portion and a rim which bounds the hollow interior portion on at least two sides, wherein said rim defines said convex-shaped face.

13. An attachment in accordance with claim 1, in which said body defines a pair of rearwardly extending legs defined on opposing side of said recess, wherein one said leg defines said convex-shaped face which engages the beveled surface of the bucket upon assembly and wherein the other leg defines and engagement face for engaging the outer surface of the bucket.

14. An attachment in accordance.with claim 13, in which said one leg further includes a free end projecting rearwardly beyond said convex-shaped face, wherein said free end defines an additional engagement face which engages the inner surface of the bucket upon assembly.

15. An attachment in accordance with claim 1, in which said leg further includes a free end projecting rearwardly beyond said convex-shaped face, wherein said free end defines an engagement face which engages the inner surface of the bucket upon assembly.

16. An attachment for mounting to a front edge of a bucket, the front edge defining an inner surface, and outer surface and a beveled surface oriented at an inclination to the inner and outer surfaces, said attachment comprising a body including a base portion adapted to engage and mount to the front edge of a bucket and a working structure projecting forwardly from said base portion, said base portion defining a recess adapted to receive the front edge of the bucket, said recess being defined by at least an end face and a convex-shaped face, said end face facing in a generally rearward direction, said convex-shaped face being adjacent to and extending rearwardly beyond said end face and engaging the beveled surface of the bucket upon assembly, said recess being continuously open rearwardly and laterally to accommodate receipt of the front edge of the bucket.

17. An attachment in accordance with claim 16, in which said convex face has a convex shape in longitudinal and lateral directions.

18. An attachment in accordance with claim 16, in which said convex face is defined by a plurality of successively arranged generally planar surfaces oriented at different angular orientations with respect to one another.

19. An attachment in accordance with claim 16, in which said convex face has an arcuate configuration.

20. An attachment in accordance with claim 16, in which said base portion further include means for facilitating connection of said attachment to the front edge of the bucket.

21. An attachment in accordance with claim 16, in which said attachment is an adapter having a structure for mounting a point.

22. An attachment in accordance with claim 16, in which said attachment is a shroud.

23. An attachment in accordance with claim 16, in which said attachment is a wing adapted to mount to a side wall of a bucket.

24. An attachment in accordance with claim 16, in which said base portion further includes an engagement face to additionally define said recess, said engagement face being inclined relative to the average slope of the convex-shaped face to engage one of the inner and outer surfaces of the bucket.

25. An attachment in accordance with claim 24, in which said engagement face is adjacent said convex-shaped face and extends beyond said convex-shaped face in the rearward direction and engages the inner surface of the bucket upon assembly.

26. An attachment in accordance with claim 25, in which said body includes a second engagement face to additionally define said recess, said second engagement face being opposed to said convex face to engage the outer surface of the bucket.

27. An attachment in accordance with claim 24, in which said engagement face is opposed to said convex-shaped face to engage the outer surface of the bucket.

28. A bucket in accordance with claim 27, in which said convex face of said attachment is defined by a plurality of generally planar surfaces arranged at different angular orientations with respect to one another.

29. A bucket in accordance with claim 27, in which said convex face of said attachment has a convex configuration in longitudinal and lateral directions.

30. A bucket in accordance with claim 27, in which said convex face of said attachment has an arcuate configuration.

31. A bucket in accordance with claim 27, in which said attachment is an adapter and said working structure is a structure for mounting a point.

32. A bucket in accordance with claim 27, in which said attachment is a shroud and said working structure is an outer surface adapted to engage the material to be collected in the bucket.

33. A bucket in accordance with claim 27, in which said attachment is a wing adapted to mount to a side wall of the bucket and said working structure is adapted to engage the material to be collected in the bucket.

34. A bucket in accordance with claim 27, in which said leg defines a hollowed interior portion and a rim which bounds the hollowed interior portion on at least two sides, wherein said rim defines said convex-shaped face adapted to engage the beveled surface of the bucket.

35. An excavation bucket comprising:

a rear wall, a bottom wall and a plurality of side walls, said walls cooperatively defining an open front and a cavity for receiving material therein, said bottom and side walls defining a front edge along the boundary of the open front, at least a portion of said front edge defining an inner surface, an outer surface and a beveled surface oriented at an inclination to the inner and outer surfaces; and at least one attachment comprising a unitary, single piece body having a rear base portion for engaging and mounting the attachment to the front edge of the bucket and a working end projecting forwardly from said base portion, said base portion including an end face facing in a generally rearward direction and at least one rearwardly extending leg having a generally convex-shaped face and engaging the beveled surface of the bucket upon assembly, said body further including a recess defined by at least said convex-shaped face and said end face, said recess being continuously open rearwardly and laterally to accommodate receipt of the front edge of the bucket.

* * * * *

UNITED STATES PATENT AND TRADEMARK OFFICE

CERTIFICATE OF CORRECTION

PATENT NO. : 5,325,615

DATED : July 5, 1994

INVENTOR(S) : Brian Hutchins et al.

It is certified that error appears in the above-indentified patent and that said Letters Patent is hereby corrected as shown below:

Column 8,

Claim 28, line 42, "24" should appear as --35--.

Claim 29, line 46, "24" should appear as --35--.

Claim 30, line 49, "24" should appear as --35--.

Claim 31, line 52, "24" should appear as --35--.

Claim 32, line 55, "24" should appear as --35--.

Claim 33, line 59, "24" should appear as --35--.

Claim 34, line 63, "24" should appear as --35--.

Signed and Sealed this

Twenty-eighth Day of May, 1996

Bruce Lehman

*Attest:*

BRUCE LEHMAN

*Attesting Officer*

*Commissioner of Patents and Trademarks*